US007492332B2

(12) United States Patent
Kim et al.

(10) Patent No.: US 7,492,332 B2
(45) Date of Patent: Feb. 17, 2009

(54) PLASMA DISPLAY PANEL DRIVING METHOD AND PLASMA DISPLAY

(75) Inventors: Tae-Seong Kim, Suwon-si (KR); Woo-Joon Chung, Suwon-si (KR); Jin-Sung Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 748 days.

(21) Appl. No.: 11/115,360

(22) Filed: Apr. 27, 2005

(65) Prior Publication Data

US 2005/0243026 A1 Nov. 3, 2005

(30) Foreign Application Priority Data

Apr. 29, 2004 (KR) ..... 10-2004-0029932

(51) Int. Cl.
*G09G 3/28* (2006.01)

(52) U.S. Cl. ..... 345/60; 345/63; 345/66; 345/68; 345/69

(58) Field of Classification Search ..... 345/60–69, 345/100, 41, 107, 205, 92, 76, 87, 204, 37, 345/210–214, 47; 315/169.4; 257/59, E29.003, 257/146; 313/581, 483, 497, 582
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| 6,294,875 | B1 | 9/2001 | Kurata et al. | |
| RE37,444 | E | 11/2001 | Kanazawa | |
| 6,340,867 | B1 * | 1/2002 | Kang | 315/169.4 |
| 6,630,916 | B1 | 10/2003 | Shinoda | |

(Continued)

FOREIGN PATENT DOCUMENTS

| | | |
|---|---|---|
| CN | 1410960 | 4/2003 |

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Prabodh M. Dharia
(74) *Attorney, Agent, or Firm*—Robert E. Bushnell, Esq.

(57) ABSTRACT

A method and apparatus for driving a plasma display panel in which discharge cells are formed by first, second, and third electrodes, has a frame divided into a plurality of subfields, each of which includes a reset period, an address period, and a sustain period. In the reset period, a voltage at the first electrode is modified from a first voltage to a second voltage, the first electrode is floated; and the voltage at the first electrode is gradually reduced to a third voltage.

18 Claims, 9 Drawing Sheets

U.S. PATENT DOCUMENTS

| | | | | |
|---|---|---|---|---|
| 6,707,436 | B2 | 3/2004 | Setoguchi et al. | |
| 6,867,754 | B2 * | 3/2005 | Kim et al. | 345/60 |
| 6,903,514 | B2 * | 6/2005 | Yun et al. | 315/169.4 |
| 7,167,145 | B2 * | 1/2007 | Kim et al. | 345/60 |
| 7,176,854 | B2 * | 2/2007 | Lee et al. | 345/60 |
| 7,196,680 | B2 * | 3/2007 | Park | 345/63 |
| 7,342,557 | B2 * | 3/2008 | Chung et al. | 345/60 |
| 7,355,564 | B2 * | 4/2008 | Kang et al. | 345/60 |
| 7,355,565 | B2 * | 4/2008 | Kim et al. | 345/60 |
| 7,365,709 | B2 * | 4/2008 | Kim et al. | 345/60 |
| 7,365,710 | B2 * | 4/2008 | Chung et al. | 345/60 |
| 7,372,433 | B2 * | 5/2008 | Kim et al. | 345/63 |
| 7,391,390 | B2 * | 6/2008 | Son | 345/60 |
| 7,420,528 | B2 * | 9/2008 | Lee | 345/60 |
| 2002/0097237 | A1 * | 7/2002 | Tomio et al. | 345/211 |
| 2002/0180669 | A1 * | 12/2002 | Kim et al. | 345/60 |
| 2003/0222863 | A1 * | 12/2003 | Yun et al. | 345/204 |
| 2004/0090395 | A1 * | 5/2004 | Park | 345/41 |
| 2004/0150587 | A1 * | 8/2004 | Lee et al. | 345/60 |
| 2005/0024294 | A1 * | 2/2005 | Kim et al. | 345/60 |
| 2005/0040770 | A1 * | 2/2005 | Kang et al. | 315/169.4 |
| 2005/0052354 | A1 * | 3/2005 | Chae et al. | 345/60 |
| 2005/0083255 | A1 * | 4/2005 | Son | 345/60 |
| 2005/0110709 | A1 * | 5/2005 | Lee | 345/60 |
| 2005/0116901 | A1 * | 6/2005 | Kim et al. | 345/60 |
| 2005/0200563 | A1 * | 9/2005 | Kim et al. | 345/60 |
| 2006/0164341 | A1 * | 7/2006 | Chung et al. | 345/67 |
| 2008/0158103 | A1 * | 7/2008 | Chung et al. | 345/60 |
| 2008/0191972 | A1 * | 8/2008 | Kim et al. | 345/63 |
| 2008/0218440 | A1 * | 9/2008 | Chung et al. | 345/60 |

FOREIGN PATENT DOCUMENTS

| | | |
|---|---|---|
| EP | 1 172 794 | 1/2002 |
| JP | 02-148645 | 6/1990 |
| JP | 2845183 | 10/1998 |
| JP | 2917279 | 4/1999 |
| JP | 2001-043804 | 2/2001 |
| JP | 2001-325888 | 11/2001 |
| KR | 10-2005-0063559 | 6/2005 |

* cited by examiner

PLASMA DISPLAY PANEL DRIVING METHOD AND PLASMA DISPLAY

CLAIM OF PRIORITY

This application makes reference to, incorporates the same herein, and claims all benefits accruing under 35 U.S.C. § 119 from an application for PLASMA DISPLAY PANEL DRIVING METHOD AND PLASMA DISPLAY earlier filed in the Korean Intellectual Property Office on 29 Apr. 2004 and there duly assigned Ser. No. 10-2004-0029932.

BACKGROUND OF THE INVENTION

1. Field of the Invention

The present invention relates to a plasma display, and more particularly, to a plasma display panel driver and a driving method thereof.

2. Description of the Related Art

Plasma display panels (PDPs) have recently been popularized from among flat panel displays because of their high brightness and light emission efficiency, and wider view angles.

A PDP is a flat display for showing characters or images using plasma generated by gas discharge. PDPs can include pixels numbering more than several million in a matrix format, in which the number of pixels are determined by the size of the PDP. A PDP structure will now be described.

Along with the general structure of the PDP, an electrode arrangement of the PDP will also be described.

The PDP includes glass substrates 1 and 6 facing each other with a predetermined gap therebetween. Scan electrodes and sustain electrodes in pairs are formed in parallel on the glass substrate, and the scan electrodes and the sustain electrodes are covered with a dielectric layer and a protection film. A plurality of address electrodes is formed on the glass substrate, and the address electrodes are covered with an insulator layer. Barrier ribs are formed on the insulator layer between the address electrodes, and phosphors are formed on the surface of the insulator layer and between the barrier ribs. The glass substrates are provided facing each other with discharge spaces between the glass substrates so that the scan electrodes and the sustain electrodes can cross the address electrodes. A discharge space between an address electrode and a crossing part of a pair of a scan electrode and a sustain electrode forms a discharge cell, which is schematically indicated.

The electrodes of the PDP have an (n×m) matrix structure in which a plurality of address electrodes are arranged in the vertical direction and a plurality of scan electrodes and sustain electrodes are arranged in pairs in the horizontal direction.

In general, a frame is divided into a plurality of subfields in the PDP, and gray scales are represented by combinations of the subfields. Each subfield has a reset period, an address period, and a sustain period. In the reset period, wall charges formed by a previous sustain discharge are erased, and wall charges are set up in order to perform a stable next address discharge. In the address period, cells which are turned on and cells which are not turned on are selected, and the wall charges are accumulated on the turned-on cells (addressed cells). In the sustain period, a sustain discharge for actually displaying images on the addressed cells is performed.

A conventional PDP driving waveform diagram, and a state of a wall voltage and an applied voltage caused by a PDP driving waveform is described as follows. The reset period will only be described in the PDP driving waveform.

The reset period includes an erase period, a rising ramp period, and a falling ramp period.

In the erase period, a voltage waveform which rises to a voltage of $V_e$ from a reference voltage is applied to the sustain electrode while the scan electrode is maintained at the reference voltage after a sustain period of a previous subfield is finished, and accordingly, positive wall charges and negative wall charges respectively formed on the sustain electrode and the scan electrode are erased after the last sustain discharge of the previous subfield is finished.

In the rising ramp period, a ramp voltage which gradually rises to a voltage of $V_{set}$ which is greater than a firing voltage from a voltage of $V_s$ which is less than the firing voltage is applied to the scan electrode. While the ramp voltage rises, weak discharges are respectively generated to the address electrode and the sustain electrode X from the scan electrode Y. Negative wall charges are stored in the scan electrode and positive wall charges are stored in the sustain electrode by the weak discharges.

In the falling ramp period, a ramp voltage which gradually falls to a negative voltage of from the voltage of is applied to the scan electrode. While the ramp voltage falls, weak discharges are generated to the scan electrode from the sustain electrode and the address electrode by the wall voltage formed at the discharge cells. Part of the wall charges formed on the sustain electrode, the scan electrode, and the address electrodes are erased by the weak discharges thereby reaching a state suitable for addressing.

In general, when the wall voltage of $V_w$ between the scan electrode and the sustain electrode at the last point of the rising ramp period is defined to be $V_{w0}$, the discharge is started when the difference between the voltage of $V_{w0}$ and an applied voltage $V_{in}$ (the voltage difference between the scan electrode and the sustain electrode) exceeds the firing voltage of $V_f$.

No discharge is generated in the earlier stage 'a' of the falling ramp period since the voltage difference between the voltage of $V_{w0}$ and the applied voltage is less than the firing voltage $V_f$. Therefore, the conventional driving waveform problematically increases the reset time because of an unnecessary reset operation such as the initial period of 'a' in the falling ramp period.

SUMMARY OF THE INVENTION

Therefore, the present invention has been made in view of the above and other problems, and it is an object of the present invention to provide a technique and apparatus of driving a PDP, where the reset time is reduced by eliminating the unnecessary reset operation in the falling ramp period of the reset period.

It is another object of the present invention to provide a technique and apparatus of driving a PDP, where misfiring which is generated in the reset operation for reducing the reset time is prevented by floating the scan electrode when a falling voltage waveform is applied to the scan electrode in the falling ramp period, and further, voltage margins of the sustain electrode to be maintained when a falling voltage is applied to the scan electrode are obtained.

It is therefore, yet another object of the present invention to provide a technique and apparatus of driving a PDP, that is more efficient, easy to implement and cost effective and yet reduce reset time.

To accomplish the above and other objects, the present invention provides a method for a PDP driving method for reducing a reset time, and a plasma display.

Additional features of the invention will be set forth in the description which follows, and in part will be apparent from the description, or may be learned by practice of the invention.

In one aspect of the present invention, provided is a method for driving a plasma display panel in which discharge cells are formed by first, second, and third electrodes, a frame is divided into a plurality of subfields each of which includes a reset period, an address period, and a sustain period. In the reset period: (a) a voltage at the first electrode is modified from a first voltage to a second voltage; (b) the first electrode is floated; and (c) the voltage at the first electrode is gradually reduced to a third voltage.

In the method, before (a), the voltage at the first electrode is gradually increased from a fourth voltage to a fifth voltage. The first voltage substantially corresponds to the fifth voltage.

In the method, a sustain discharge voltage is alternately applied to the first electrode and the second electrode in a sustain period of a previous subfield, and the first voltage corresponds to the sustain discharge voltage applied to the first electrode.

The second voltage is lower than the sustain discharge voltage applied to the first electrode in the sustain period, and the second voltage is a ground voltage.

In another aspect of the present invention, a plasma display comprises a plasma display panel and a driving circuit. The plasma display panel forms discharge cells between first, second, and third electrodes, and the driving circuit includes a reset period, an address period, and a sustain period, and applies driving signals to the first, second, and third electrodes.

The driving circuit modifies a voltage at the first electrode from a first voltage to a second voltage, floats the first electrode, and gradually reduces the voltage at the first electrode to the third voltage in a reset period. The present invention can also be realized as computer-executable instructions in computer-readable media.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
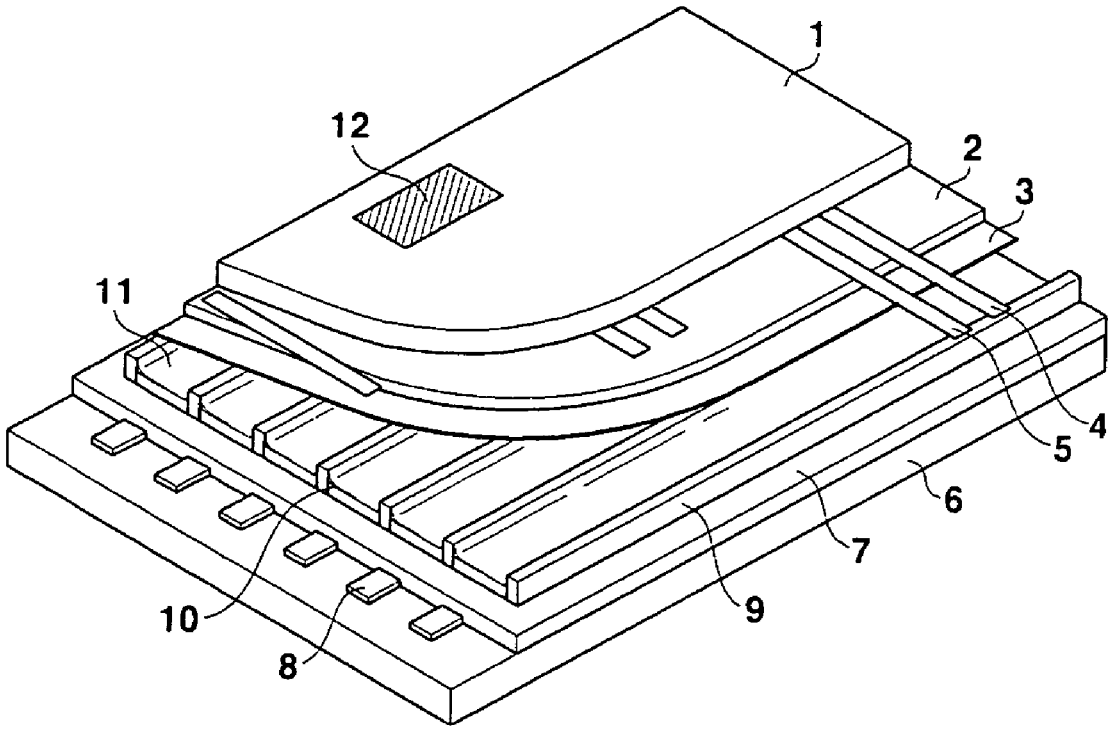
FIG.1 (Prior Art)
FIG. 1 shows a partial perspective view of a general PDP according to the prior art.
Figure 2:
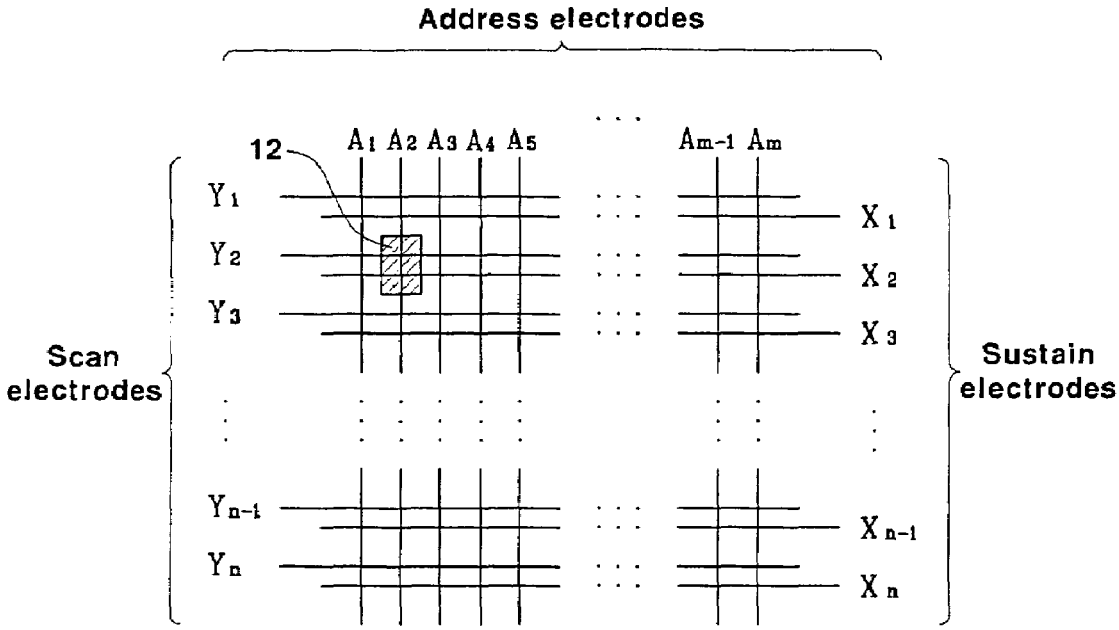
FIG.2 (Prior Art)
FIG. 2 schematically shows an electrode arrangement of the prior art PDP of FIG. 1.

Referring to FIGS. 1 and 2, a PDP structure according to the prior art will now be described. FIG. 1 shows a partial perspective view of the PDP according to the prior art, and FIG. 2 schematically shows an electrode arrangement of the PDP of FIG. 1 according to the prior art.

As shown in FIG. 1, the PDP includes glass substrates 1 and 6 facing each other with a predetermined gap therebetween. Scan electrodes 4 and sustain electrodes 5 in pairs are formed in parallel on the glass substrate 1, and the scan electrodes 4 and the sustain electrodes 5 are covered with a dielectric layer 2 and a protection film 3. A plurality of address electrodes 8 is formed on the glass substrate 6, and the address electrodes 8 are covered with an insulator layer 7. Barrier ribs 9 are formed on the insulator layer 7 between the address electrodes 8, and phosphors 10 are formed on the surface of the insulator layer 7 and between the barrier ribs 9. The glass substrates 1 and 6 are provided facing each other with discharge spaces between the glass substrates 1 and 6 so that the scan electrodes 4 and the sustain electrodes 5 can cross the address electrodes 8. A discharge space 11 between an address electrode 8 and a crossing part of a pair of a scan electrode 4 and a sustain electrode 5 forms a discharge cell 12, which is schematically indicated.

As shown in FIG. 2, electrodes of the prior art PDP of FIG. 1 has an (n×m) matrix structure in which a plurality of address electrodes $A_1$ to $A_m$ is arranged in the vertical direction and a plurality of scan electrodes $Y_l$ to $Y_n$ and sustain electrodes $X_l$ to $X_n$ are arranged in pairs in the horizontal direction.

In general, a frame is divided into a plurality of subfields in the PDP, and gray scales are represented by combinations of the subfields. Each subfield has a reset period, an address period, and a sustain period. In the reset period, wall charges formed by a previous sustain discharge are erased, and wall charges are set up in order to perform a stable next address discharge. In the address period, cells which are turned on and cells which are not turned on are selected, and the wall charges are accumulated on the turned-on cells (addressed cells). In the sustain period, a sustain discharge for actually displaying images on the addressed cells is performed.

Figure 3:
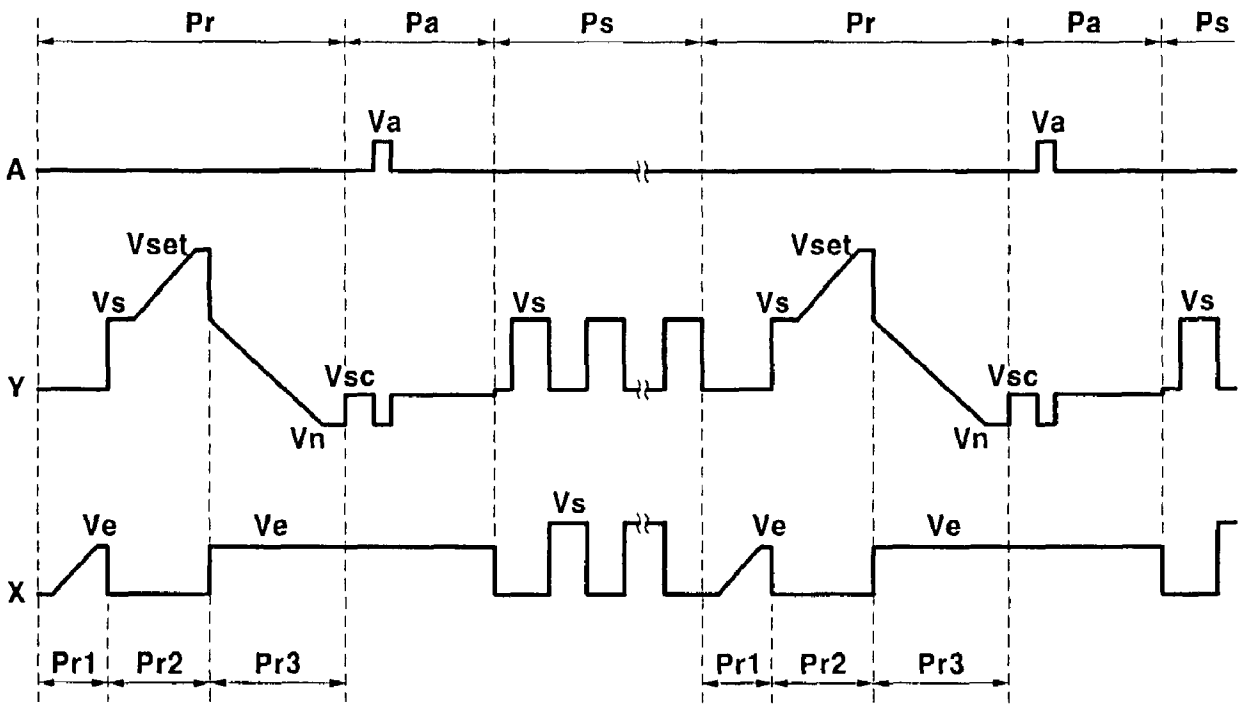
FIG.3 (Conventional Art)
FIG. 3 shows a conventional PDP driving waveform diagram.
Figure 4:
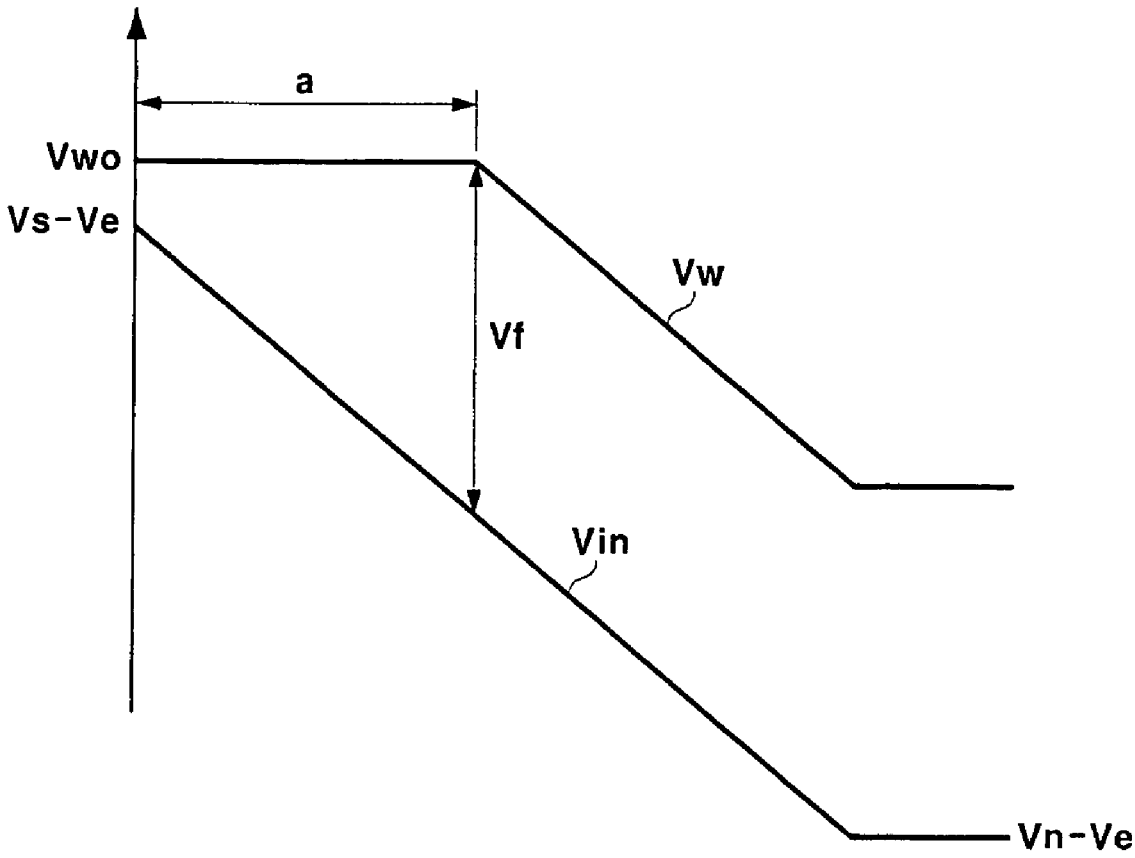
FIG.4 (Conventional Art)
FIG. 4 shows a state of a wall voltage and an applied voltage caused by a PDP driving waveform according to the conventional art.

FIG. 3 shows a conventional PDP driving waveform diagram, and FIG. 4 shows a state of a wall voltage and an applied voltage caused by a PDP driving waveform according to the conventional art. The reset period $P_r$ will only be described in the PDP driving waveform.

As shown in FIG. 3, the reset period $P_r$ includes an erase period $P_{r1}$, a rising ramp period $P_{r2}$, and a falling ramp period $P_{r3}$.

In the erase period $P_{r1}$, a voltage waveform which rises to a voltage of $V_e$ from a reference voltage is applied to the sustain electrode X while the scan electrode Y is maintained at the reference voltage after a sustain period $P_s$ of a previous subfield is finished, and accordingly, positive wall charges and negative wall charges respectively formed on the sustain electrode X and the scan electrode Y are erased after the last sustain discharge of the previous subfield is finished.

In the rising ramp period $P_{r2}$, a ramp voltage which gradually rises to a voltage of $V_{set}$ which is greater than a firing voltage from a voltage of $V_s$ which is less than the firing voltage, is applied to the scan electrode Y. While the ramp voltage rises, weak discharges are respectively generated to the address electrode A and the sustain electrode X from the scan electrode Y. Negative wall charges are stored in the scan electrode Y and positive wall charges are stored in the sustain electrode X by the weak discharges.

In the falling ramp period $P_{r3}$, a ramp voltage which gradually falls to a negative voltage of $V_n$ from the voltage of $V_s$, is applied to the scan electrode Y. While the ramp voltage falls, weak discharges are generated to the scan electrode Y from the sustain electrode X and the address electrode A by the wall voltage formed at the discharge cells. Part of the wall charges formed on the sustain electrode X, the scan electrode Y, and the address electrodes $A_1$ to $A_m$ are erased by the weak discharges thereby reaching a state suitable for addressing.

In general, when the wall voltage of $V_w$ between the scan electrode Y and the sustain electrode X at the last point of the rising ramp period $P_{r2}$ is defined to be $V_{w0}$, the discharge is started when the difference between the voltage of $V_{w0}$ and an applied voltage $V_{in}$ (the voltage difference between the scan electrode Y and the sustain electrode X) exceeds the firing voltage of $V_f$.

Referring to FIG. 4, no discharge is generated in the earlier stage 'a' of the falling ramp period $P_{r3}$ since the voltage difference between the voltage of $V_{w0}$ and the applied voltage is less than the firing voltage $V_f$. Therefore, the conventional driving waveform shown in FIG. 3 problematically increases the reset time because of an unnecessary reset operation such as the initial period of 'a' in the falling ramp period $P_{r3}$.

In the following detailed description, exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive.

In the drawings, illustrations of elements having no relation with the present invention are omitted in order to more clearly present the subject matter of the present invention. In the specification, the same or similar elements are denoted by the same reference numerals even though they are depicted in different drawings.

Exemplary embodiments of the present invention will now be described in detail with reference to the annexed drawings.

Figure 5:
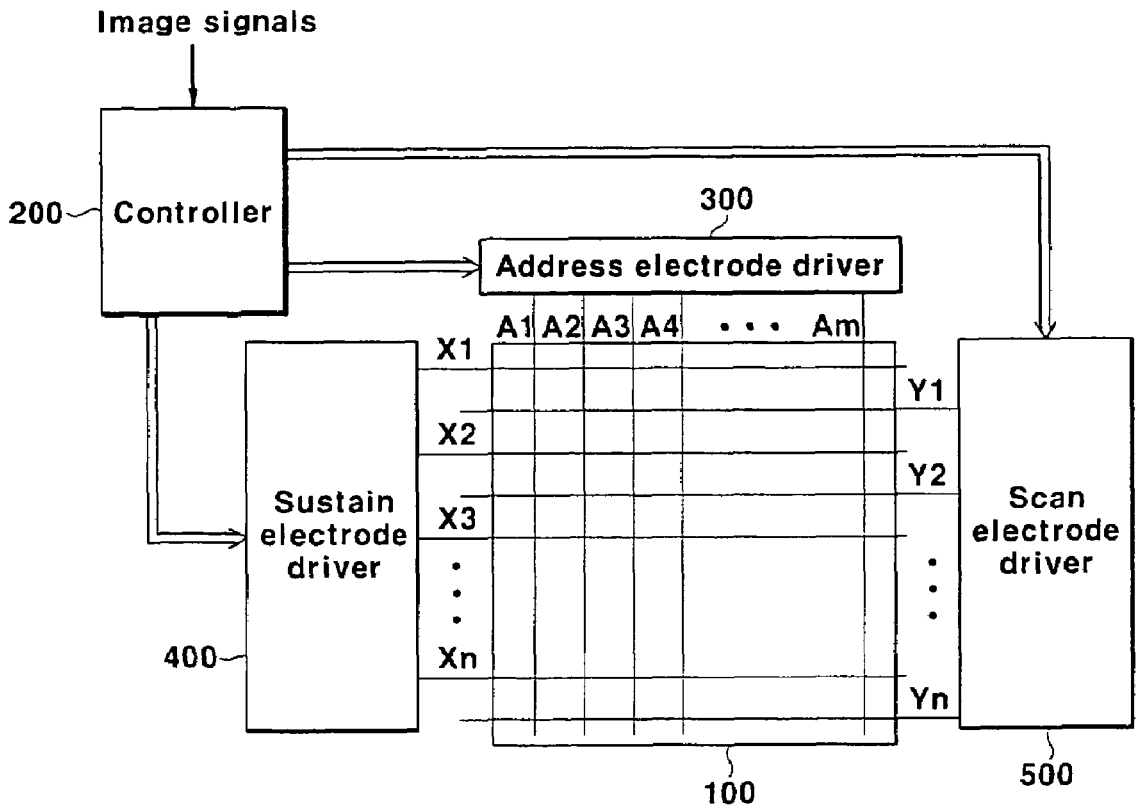
FIG. 5 shows a PDP according to an exemplary embodiment of the present invention.

FIG. 5 shows a PDP according to an exemplary embodiment of the present invention.

As shown, the PDP includes a plasma panel 100, a controller 200, an address driver 300, a sustain electrode driver 400, and a scan electrode driver 500.

The plasma panel 100 includes a plurality of address electrodes A1 to Am arranged in the column direction, and a plurality of sustain electrodes X1 to Xn and scan electrodes Y1 to Yn arranged in the row direction.

The controller 200 receives an external image signal, and outputs an address driving control signal, a sustain electrode driving control signal, and a scan electrode driving control signal. The controller 200 divides a frame into plural subfields and drives them, and each subfield includes a reset period, an address period, and a sustain period in a temporal manner.

The address driver 300 receives an address driving control signal from the controller 200, and applies a display data signal for selecting a discharge cell to be displayed to each address electrode.

The sustain electrode driver 400 receives a sustain electrode driving control signal from the controller 200, and applies a driving voltage to the sustain electrode X.

The scan electrode driver 500 receives a scan electrode driving control signal from the controller 200, and applies a driving voltage to the scan electrode Y.

Referring to FIGS. 6 to 9, PDP driving methods according to the first to fourth exemplary embodiments will be described. A reference voltage is assumed to be 0V (volts), and the wall charges represent charges which are formed on the wall (e.g., a dielectric layer) of discharge cells near each electrode and are accumulated on the electrode. The wall charges are not actually contacted on the electrode, but they will be described to be "formed," "accumulated," or "piled" on the electrode. Also, the wall voltage represents a potential difference formed on the wall of discharge cells by the wall charges.

Figure 6:
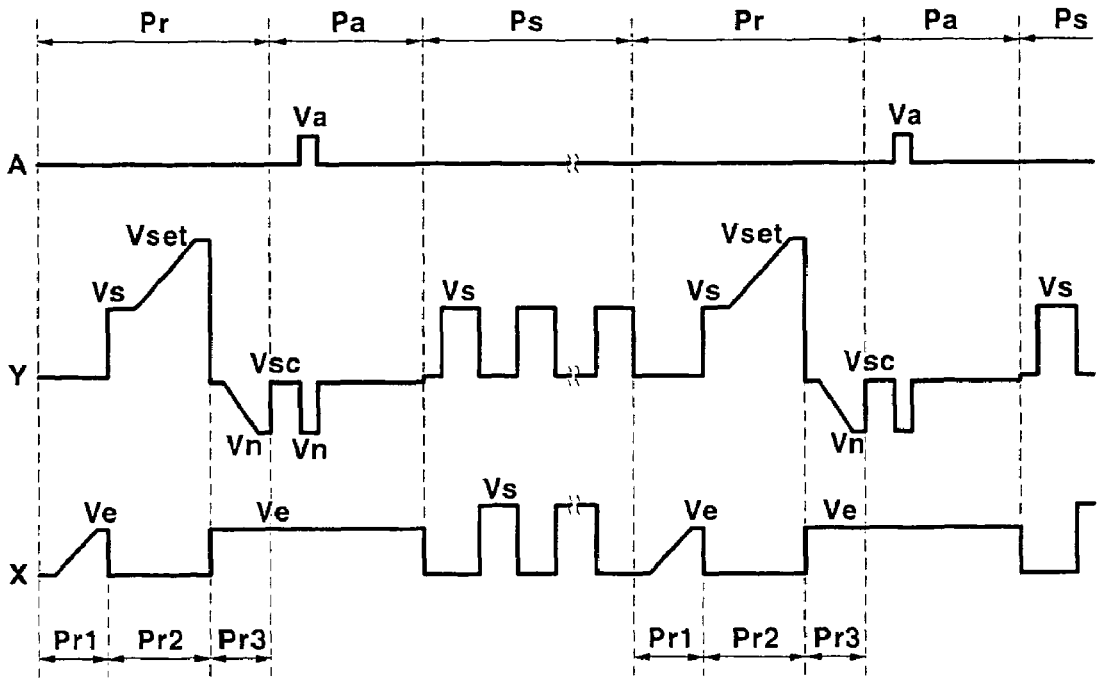
FIG. 6 shows a PDP driving waveform diagram according to a first exemplary embodiment of the present invention.

FIG. 6 shows a PDP driving waveform diagram according to a first exemplary embodiment of the present invention.

As shown, each subfield in the PDP driving waveform according to the first embodiment includes a reset period $P_r$, an address period $P_a$, and a sustain period $P_s$. The reset period $P_r$ includes an erase period $P_{r1}$, a rising ramp period $P_{r2}$, and a falling ramp period $P_{r3}$.

In the erase period $P_{r1}$ of the reset period $P_r$, charges formed by a sustain discharge in the sustain period $P_s$ of the previous subfield are erased. In the rising ramp period $P_{r2}$, wall charges are formed on the scan electrode Y, the sustain electrode X, and the address electrode A. In the falling ramp period $P_{r3}$, part of the wall charges formed in the rising ramp period $P_{r2}$ are erased to help an address discharge. In the reset period ($P_r$), the wall charges formed by a previous sustain discharge are erased, and wall charges are set up in order to perform a stable subsequent address discharge. In the address period ($P_a$), the cells which are turned on and the cells which are not turned on are selected, and the wall charges are accumulated on the turned-on cells (addressed cells). In the sustain period ($P_s$), a sustain discharge for actually displaying images on the addressed cells is performed.

In the PDP, a scan/sustain (scan and sustain) driving circuit for applying a driving voltage to the scan electrode Y and the sustain electrode X and an address driving circuit for applying a driving voltage to the address electrode A in each period $P_r$ (reset period), $P_a$ (address period), and $P_s$ (sustain period) are coupled with each other to thus configure a display device.

When the last sustain discharge is finished in the sustain period $P_s$, the positive wall charges and the negative wall charges are respectively formed on the sustain electrode X and the scan electrode Y. Therefore, a voltage waveform, which rises to the voltage of $V_e$ from the reference voltage, is applied to the sustain electrode X in the erase period $P_{r1}$ of the reset period $P_r$ while the scan electrode Y is maintained at the reference voltage after the sustain period $P_s$ is finished. Hence, the wall charges formed on the sustain electrode and the scan electrode are erased.

In the rising ramp period $P_{r2}$ of the reset period $P_r$, a rising voltage waveform, which rises to the voltage of $V_{set}$ from the voltage of $V_s$, is applied to the scan electrode Y while the address electrode A and the sustain electrode X are maintained at the reference voltage of 0V (zero volts). While the rising voltage waveform is applied, reset discharges are generated in the discharge cells, negative wall charges are formed on the scan electrode Y, and positive wall charges are formed on the sustain electrode X and the address electrode A.

In the falling ramp period $P_{r3}$ of the reset period $P_r$, the voltage at the scan electrode Y is reduced to the reference voltage from the voltage of $V_{set}$ and a voltage waveform which gradually falls to the negative voltage of $V_n$ from the reference voltage is applied to the scan electrode Y while the voltage at the sustain electrode X is maintained at the voltage of $V_e$. Therefore, the reset time is shortened compared to that of the conventional driving waveform when the voltage at the scan electrode Y is modified to the reference voltage from the voltage of $V_{set}$ and a voltage waveform gradually falling to the negative voltage of $V_n$ is applied to the scan electrode during an initial period of the falling ramp period $P_{r3}$ in which no discharge is generated. In this instance, it is controlled in the falling ramp period $P_{r3}$ that the wall charges formed on the scan electrode Y and the sustain electrode X are erased and the wall voltage in the final part of the falling ramp period $P_{r3}$ reaches 0 V. Hence, since the difference of the final voltages applied to the sustain electrode X and the scan electrode Y is maintained at the firing voltage, the voltage at the sustain electrode X is further lowered as the negative voltage at the scan electrode Y is further lowered.

In the address period $P_a$, the voltage of $V_n$ is sequentially applied to the scan electrodes Y to select a scan electrode Y, and an address voltage $V_a$ is applied to the address electrode A forming a discharge cell to be selected from among the discharge cells formed by the scan electrode Y to which the voltage of $V_n$ is applied. As a result, an address discharge is performed by the difference between the voltage of $V_a$ applied to the address electrode A and the voltage of $V_n$ applied to the scan electrode Y and the wall voltage caused by the wall charges formed on the address electrode A and the scan electrode Y. The positive wall charges are accumulated on the scan electrode Y and the negative wall charges are accumulated on the sustain electrode X and the address electrode A by the above-noted discharge.

A sustain discharge is generated at the discharges cells in which the wall charges are accumulated by an address discharge, by the sustain discharge pulse applied to the scan electrode Y and the sustain electrode X in the sustain period $P_s$. The sustain discharge pulse represents a pulse which controls the voltage difference between the scan electrode Y and the sustain electrode X to be a voltage of $V_s$ and $-V_s$ alternately.

However, in the driving waveform according to the first embodiment, a misfiring may be generated because of a steep potential difference between the sustain electrode X and the scan electrode Y when the voltage of $V_e$ is applied to the sustain electrode X and the voltage at the scan electrode Y is modified to the reference voltage from the voltage of $V_{set}$. Therefore, the wall charges are not stably controlled because of generation of the misfiring in the reset period. To solve this, a misfiring preventing embodiment will be described with reference to FIGS. 7 to 9.

Figure 7:
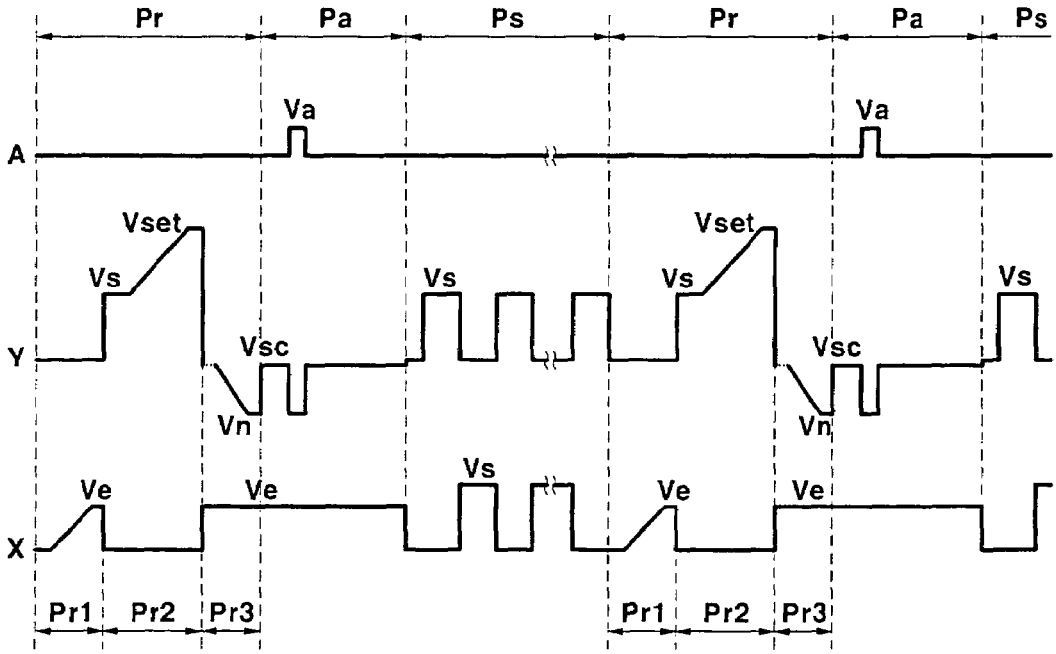
FIG. 7 shows a PDP driving waveform diagram according to a second exemplary embodiment of the present invention.

FIG. 7 shows a PDP driving waveform diagram according to a second exemplary embodiment of the present invention.

As shown, in the falling ramp period $P_{r3}$ of the reset period $P_r$, the voltage at the scan electrode Y is reduced to the reference voltage from the voltage of $V_{set}$ and the scan electrode Y is floated for a predetermined time while the voltage at the sustain electrode X is maintained at the voltage of $V_e$. A voltage waveform which gradually falls to the negative voltage of $V_n$ from the reference voltage is then applied to the scan electrode Y. Accordingly, a strong discharge can be generated by the wall voltage caused by the wall charges formed on the sustain electrode X and the scan electrode Y and the voltage of $V_e$ applied to the sustain electrode X in the rising ramp period $P_{r2}$ of the reset period $P_r$ when the voltage at the scan electrode Y is modified to the reference voltage from the voltage of $V_{set}$. In this instance, when the scan electrode Y is floated, no current is supplied to the scan electrode Y, and hence, supply of charges is intercepted, the discharge is swiftly quenched, and the strong discharge is prevented. When a falling voltage is applied to the scan electrode Y, the reset discharge is generated at the discharge cells, the negative wall charges on the scan electrode Y are reduced, and the positive wall charges on the sustain electrode X and the address electrode A are reduced.

In the second embodiment, an erase period has been provided to erase the wall charges of cells formed in the sustain period of the previous subfield. Further, the erase period can be eliminated which will be described with reference to FIG. 8.

Figure 8:
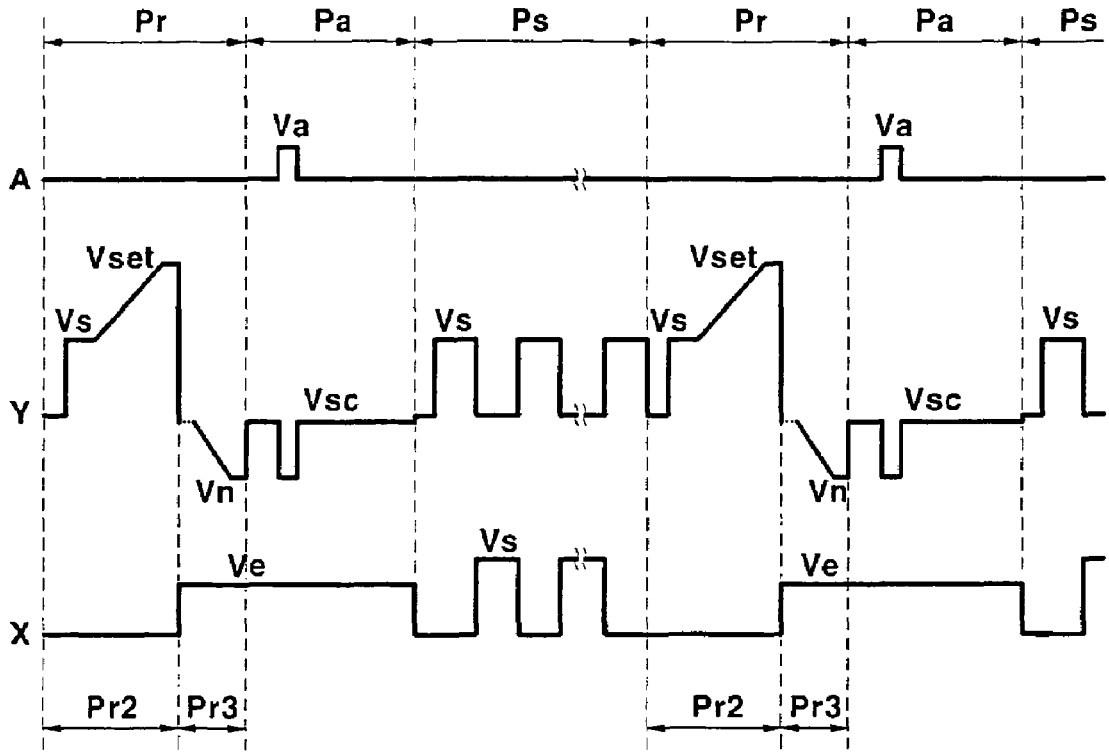
FIG. 8 shows a PDP driving waveform diagram according to a third exemplary embodiment of the present invention.

FIG. 8 shows a PDP driving waveform diagram according to a third exemplary embodiment of the present invention.

Referring to FIG. 8, the voltage of Vs applied to the scan electrode Y in the sustain period of the previous subfield can be represented by eliminating the erase period (i.e., $P_{r1}$) and combining the above-noted voltage of $V_s$ with the sustain discharge pulse applied in the sustain period ($P_s$) of the previous subfield and the voltage of $V_s$ applied to the scan electrode Y of the subsequent subfield since the voltage of $V_s$ applied to the scan electrode Y in the sustain period ($P_s$) of the previous subfield corresponds to the voltage of $V_s$ applied to the scan electrode Y in the reset period ($P_r$) of the subsequent subfield. That is, the voltage at the scan electrode Y is gradually increased to the voltage of $V_{set}$ in the sustain period of the subsequent subfield while the voltage of $V_s$ is applied to the scan electrode Y. Therefore, the negative wall charges and the positive wall charges are additionally formed on the scan electrode Y and the sustain electrode X respectively by the rising voltage waveform while the negative wall charges and the positive wall charges are formed on the scan electrode Y and the sustain electrode X by the voltage of $V_s$ applied to the scan electrode Y and the reference voltage of 0 V applied to the sustain electrode X in the sustain period ($P_s$) of the previous subfield.

The falling voltage waveform has been applied after the rising voltage waveform has been applied in the reset period ($P_r$) in the third embodiment, and differing from this, a rising voltage waveform and a falling voltage waveform will be applied in the main reset period (i.e., $P_{r_main}$), and a falling voltage waveform will be applied in the sub reset period (i.e., $P_{r_sub}$) in a fourth embodiment, which will now be described with reference to FIG. 9.

Figure 9:
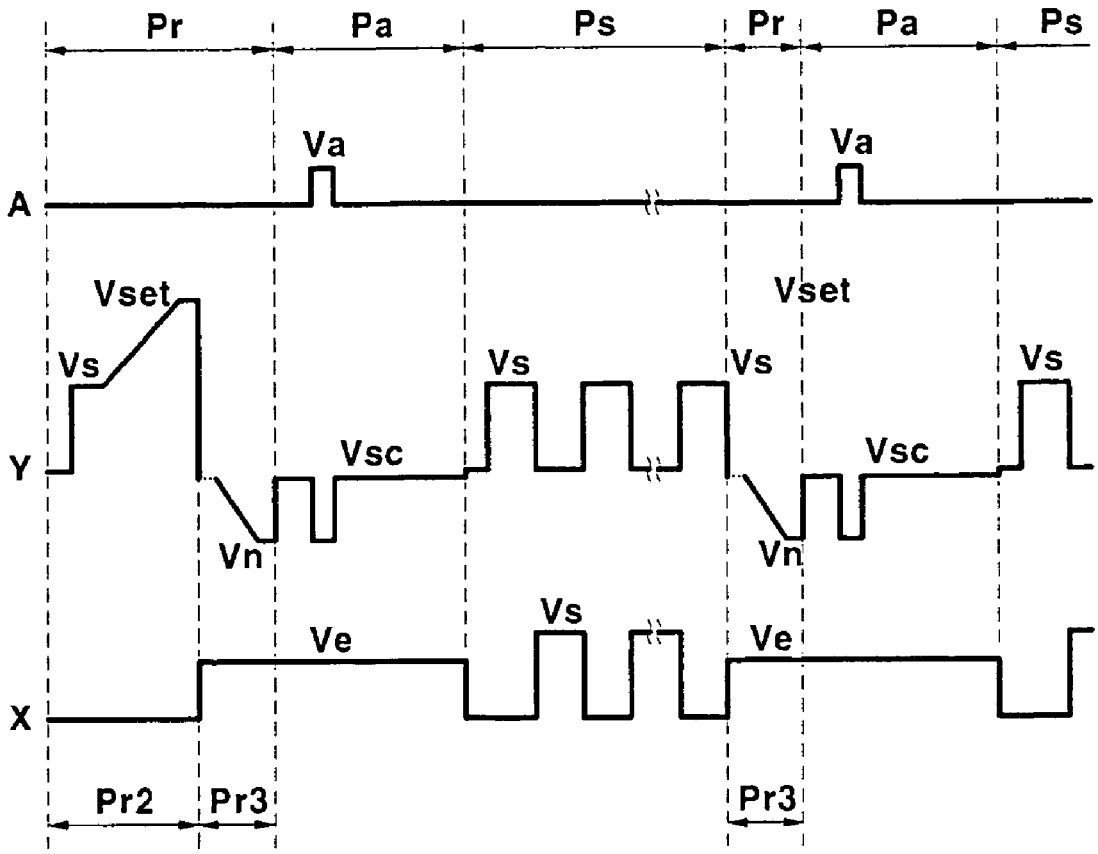
FIG. 9 shows a PDP driving waveform diagram according to a fourth exemplary embodiment of the present invention.

FIG. 9 shows a PDP driving waveform diagram according to the fourth exemplary embodiment of the present invention.

As shown, a main reset period $P_{r_main}$ is formed in the first subfield from among a plurality of subfields which configure a frame, and sub reset periods $P_{r_sub}$ are formed in the subsequent subfields. The method for driving the PDP with different waveforms which are applied in the reset period is disclosed in U.S. Pat. No. 6,294,875 by Kurata for *Method of Driving AC Plasma Display Panel*.

A voltage waveform rising to the voltage of $V_{set}$ from the voltage of $V_s$ is applied to the scan electrode Y and the voltage at the scan electrode Y is reduced to the reference voltage from the voltage of $V_{set}$ in a like manner of the driving waveform of FIG. 6 in the main reset period $P_{r_main}$ which is a reset period of the first subfield in the PDP driving waveform. While the voltage at the sustain electrode X is maintained at the voltage of $V_e$, the scan electrode Y is floated for a predetermined time, and a voltage waveform falling to the voltage of $V_n$ from the reference voltage is applied to the scan electrode Y.

In the sub reset period $P_{r_sub}$ which is a reset period of second or subsequent subfields, the reference voltage is applied to the scan electrode Y, the scan electrode is then floated in the sustain period $P_s$ of the first subfield, and a voltage waveform falling to the voltage of $V_n$ from the reference voltage is applied. As a result, the strong discharge which is generated by applying the voltage of $V_e$ to the sustain electrode X is prevented by floating while the negative wall charges and the positive wall charges are formed on the scan electrode Y and the sustain electrode X in the sustain period $P_s$ of the first subfield.

In general, a rising voltage waveform is applied to the scan electrode Y so as to form a large amount of wall charges in the discharge cells in the reset period. However, it is not needed to form wall charges in the reset period since a large quantity of wall charges are already formed in the discharge cells which emitted light in the sustain period of the previous subfields after the second subfield. Also, it is not needed to perform a reset operation in the subsequent subfield since the wall charges formed in the reset period are not modified in the discharge cells which are not emitted in the sustain period. The discharge cells are maintained at the reset state since no discharge is generated when a falling voltage waveform is applied to the scan electrode Y in this state.

The present invention can be realized as computer-executable instructions in computer-readable media. The computer-readable media includes all possible kinds of media in which computer-readable data is stored or included or can include any type of data that can be read by a computer or a processing unit. The computer-readable media include for example and not limited to storing media, such as magnetic storing media (e.g., ROMs, floppy disks, hard disk, and the like), optical reading media (e.g., CD-ROMs (compact disc-read-only memory), DVDs (digital versatile discs), re-writable versions of the optical discs, and the like), hybrid magnetic optical disks, organic disks, system memory (read-only memory, random access memory), non-volatile memory such as flash memory or any other volatile or non-volatile memory, other semiconductor media, electronic media, electromagnetic media, infrared, and other communication media such as carrier waves (e.g., transmission via the Internet or another computer). Communication media generally embodies computer-readable instructions, data structures, program modules or other data in a modulated signal such as the carrier waves or other transportable mechanism including any information delivery media. Computer-readable media such as communication media may include wireless media such as radio frequency, infrared microwaves, and wired media such as a wired network. Also, the computer-readable media can store and execute computer-readable codes that are distributed in computers connected via a network. The computer readable medium also includes cooperating or interconnected computer readable media that are in the processing system or are distributed among multiple processing systems that may be local or remote to the processing system. The present invention can include the computer-readable medium having stored thereon a data structure including a plurality of fields containing data representing the techniques of the present invention.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

According to the present invention, the reset time is reduced by eliminating the unnecessary reset operation in the falling ramp period of the reset period.

Misfiring which is generated in the reset operation for reducing the reset time is prevented by floating the scan electrode Y when a falling voltage waveform is applied to the scan electrode Y in the falling ramp period, and further, voltage margins of the sustain electrode X to be maintained when a falling voltage is applied to the scan electrode Y are obtained.

What is claimed is:

1. A method for driving a plasma display panel in which discharge cells are formed by first, second, and third electrodes, a frame is divided into a plurality of subfields each of which includes a reset period, an address period, and a sustain period, the method comprising:

in the reset period, modifying a voltage at said first electrode from a first voltage to a second voltage;

floating said first electrode; and gradually reducing the voltage at said first electrode to a third voltage.

2. The method of claim 1, further comprising, before modifying the voltage at said first electrode from the first voltage to the second voltage, gradually increasing the voltage at the first electrode from a fourth voltage to a fifth voltage.

3. The method of claim 2, wherein the first voltage substantially corresponds to the fifth voltage.

4. The method of claim 1, further comprising: alternately applying a sustain discharge voltage to said first electrode and said second electrode in a sustain period of a previous subfield, the first voltage corresponding to the sustain discharge voltage applied to said first electrode.

5. The method of claim 1, wherein the second voltage is lower than the sustain discharge voltage applied to said first electrode in the sustain period.

6. The method of claim 5, wherein the second voltage is a ground voltage.

7. A plasma display comprising:

a plasma display panel forming discharge cells between first, second, and third electrodes; and a driving circuit including a reset period, an address period, and a sustain period, and applying driving signals to said first, second, and third electrodes, said driving circuit modifies a voltage at said first electrode from a first voltage to a second voltage, floats said first electrode, and gradually reduces the voltage at said first electrode to the third voltage in the reset period.

8. The plasma display of claim 7, wherein said driving circuit gradually increases the voltage at said first electrode from a fourth voltage to a fifth voltage in the reset period, and the fifth voltage corresponds to the first voltage.

9. The plasma display of claim 7, wherein said driving circuit alternately applies a sustain discharge voltage to said first electrode and said second electrode in the sustain period of a previous subfield, and the first voltage corresponds to the sustain discharge voltage.

10. The plasma display of claim 7, wherein the second voltage is lower than the sustain discharge voltage applied to said first electrode in the sustain period.

11. The plasma display of claim 8, wherein the second voltage is lower than the sustain discharge voltage applied to said first electrode in the sustain period.

12. The plasma display of claim 9, wherein the second voltage is lower than the sustain discharge voltage applied to said first electrode in the sustain period.

13. A method for driving a plasma display panel, comprising:

modifying a voltage at a first electrode from a first voltage to a second voltage during a reset period, with the reset period being when wall charges formed by a previous sustain discharge are erased, and wall charges are set up in order to perform a stable next address discharge, with at least said first electrode, a second electrode and a third electrode forming discharge cells;

floating said first electrode during the reset period; and regularly step by step reducing the voltage at said first electrode to a third voltage during the reset period.

14. The method of claim 13, with the regular step by step reduction of the voltage at said first electrode to the third voltage during the reset period being a negative voltage applied to said first electrode during an initial period of a falling ramp period of the reset period in which no discharge is generated, the difference of the final voltages applied to said first and second electrodes being maintained at firing voltage, the voltage at said second electrode being further reduced as the negative voltage at said first electrode is further reduced.

15. The method of claim 13, with the floating of said first electrode being for a predetermined time during the reset period while voltage at said second electrode being maintained at a certain voltage, and a voltage waveform regularly reducing step by step being reduced to a certain negative voltage from the reference voltage is then applied to said first electrode.

16. The method of claim 13, further comprising a regular step by step rising of the voltage applied to said first electrode directly before the step by step reduction of the voltage at said first electrode and directly after a sustain period where a sustain discharge for displaying images on addressed cells is performed.

17. The method of claim 13, with the regular step by step rising of the voltage and the regular step by step reduction of the voltage being applied during a first reset period and only the regular step by step reduction of the voltage without the regular step by step rising of the voltage being applied in the next reset period.

18. The method of claim 13, further comprising:

before modifying the voltage at said first electrode from the first voltage to the second voltage, gradually increasing the voltage at the first electrode from a fourth voltage to a fifth voltage, the first voltage substantially corresponding to the fifth voltage; and alternately applying a sustain discharge voltage to said first electrode and said second electrode in a sustain period of a previous subfield, the first voltage corresponding to the sustain discharge voltage applied to said first electrode, the second voltage being lower than the sustain discharge voltage applied to said first electrode in the sustain period, the second voltage being a ground voltage.

* * * * *